US008646130B2

(12) United States Patent
Alzoubi et al.

(10) Patent No.: US 8,646,130 B2
(45) Date of Patent: Feb. 11, 2014

(54) MATTRESS RETENTION BRACKET ASSEMBLY AND METHOD

(75) Inventors: Mohamed F. Alzoubi, Johnson City, TN (US); Stephen Switzer, Kingsport, TN (US)

(73) Assignee: Tempur-Pedic Management, LLC, Lexington, KY (US)

( * ) Notice: Subject to any disclaimer, the term of this patent is extended or adjusted under 35 U.S.C. 154(b) by 11 days.

(21) Appl. No.: 13/189,792

(22) Filed: Jul. 25, 2011

(65) Prior Publication Data

US 2012/0017373 A1 Jan. 26, 2012

Related U.S. Application Data

(60) Provisional application No. 61/367,643, filed on Jul. 26, 2010.

(51) Int. Cl.
*A47C 27/00* (2006.01)
*A47C 19/00* (2006.01)

(52) U.S. Cl.
USPC ..... 5/411; 5/425; 5/193

(58) Field of Classification Search
USPC ..... 5/193, 200.1, 411, 658, 691, 613, 659, 5/503.1–507.1, 424–426, 618
See application file for complete search history.

(56) References Cited

U.S. PATENT DOCUMENTS 764,842 A 7/1904 Fauber
809,049 A * 1/1906 Gillett ..... 24/547
1,031,656 A * 7/1912 Mellon ..... 5/193
1,090,875 A * 3/1914 Poland ..... 5/193
1,125,277 A * 1/1915 Eckerson ..... 5/193
1,163,051 A * 12/1915 Weborg ..... 5/193
1,231,469 A 6/1917 Anderson
1,238,441 A 8/1917 Russell
1,336,003 A * 4/1920 Van Demark ..... 5/193
1,371,098 A 3/1921 Jones
1,384,600 A 7/1921 Coil
1,398,203 A 11/1921 Schmidt
1,467,369 A 9/1923 Freemon
1,559,119 A 10/1925 Miller
1,597,024 A 8/1926 Duvall
1,693,795 A 12/1928 Moore
1,698,077 A 1/1929 Travis et al.
1,842,873 A 1/1932 Leeking
2,067,515 A 1/1937 Twomey
2,147,538 A 2/1939 Maguire et al.
2,257,554 A 9/1941 Hitchcock
2,588,854 A 3/1952 Lang
3,222,693 A 12/1965 Pruim et al.
3,242,507 A 3/1966 Peterson
3,465,373 A 9/1969 Wilson
4,091,480 A * 5/1978 Oxenburg ..... 5/695
4,104,749 A 8/1978 Grundler
4,110,856 A 9/1978 Benoit et al.
4,202,062 A * 5/1980 Marcyan ..... 5/620
4,297,754 A 11/1981 Zuniga
4,458,371 A 7/1984 Whitehead (Continued)

*Primary Examiner* — Robert G Santos
*Assistant Examiner* — Myles Throop

(57) ABSTRACT

A body support assembly includes a body support having a head portion, a middle portion, and a foot portion. The body support assembly also includes a foundation underlying and supporting the body support proximate an edge of the body support at one of the head and foot portions, and a bracket coupled to the foundation and slideable between first and second positions at different distances with respect to the edge of the body support.

20 Claims, 6 Drawing Sheets

(56) References Cited

U.S. PATENT DOCUMENTS

| | | | | |
|---|---|---|---|---|
| 4,554,692 | A * | 11/1985 | Whitehead | 5/411 |
| 5,255,403 | A * | 10/1993 | Ortiz | 5/503.1 |
| D379,283 | S | 5/1997 | Antinori | |
| 5,737,783 | A * | 4/1998 | Antinori | 5/411 |
| 5,758,372 | A | 6/1998 | Lopez Diaz | |
| 5,978,992 | A | 11/1999 | Antinori | |
| 6,035,467 | A * | 3/2000 | Lee | 5/174 |
| 6,684,425 | B2 | 2/2004 | Davis | |
| 6,735,797 | B1 | 5/2004 | Long et al. | |
| 6,889,396 | B2 | 5/2005 | Weinman | |
| 6,907,631 | B2 | 6/2005 | Heaton | |
| 6,934,984 | B2 * | 8/2005 | Marsden et al. | 5/426 |
| 7,017,210 | B2 | 3/2006 | Ooyama et al. | |
| 7,036,170 | B2 | 5/2006 | Antinori | |
| 7,039,971 | B2 * | 5/2006 | Sebastien | 5/662 |
| 7,047,579 | B2 * | 5/2006 | Piana et al. | 5/411 |
| 7,171,708 | B2 | 2/2007 | Osborne et al. | |
| 7,222,377 | B2 * | 5/2007 | Kramer et al. | 5/425 |
| 7,234,178 | B2 | 6/2007 | Qi | |
| 7,321,811 | B1 | 1/2008 | Rawls-Meehan | |
| 7,353,550 | B2 | 4/2008 | Antinori | |
| 7,373,679 | B2 * | 5/2008 | Miller | 5/662 |
| 7,465,280 | B2 | 12/2008 | Rawls-Meehan | |
| 7,607,181 | B1 * | 10/2009 | Harrison | 5/411 |
| 7,930,780 | B2 * | 4/2011 | Clenet | 5/618 |
| 2005/0210587 | A1 * | 9/2005 | Piana et al. | 5/618 |
| 2006/0168725 | A1 * | 8/2006 | Antinori | 5/411 |
| 2006/0253983 | A1 | 11/2006 | Falabrino | |
| 2008/0000027 | A1 | 1/2008 | Clenet | |
| 2008/0104754 | A1 | 5/2008 | Rawls-Meehan | |
| 2008/0104755 | A1 | 5/2008 | Rawls-Meehan | |
| 2008/0104756 | A1 | 5/2008 | Rawls-Meehan | |
| 2008/0104757 | A1 | 5/2008 | Rawls-Meehan | |
| 2008/0104758 | A1 | 5/2008 | Rawls-Meehan | |
| 2008/0104759 | A1 | 5/2008 | Rawls-Meehan | |
| 2008/0104760 | A1 | 5/2008 | Rawls-Meehan | |
| 2008/0104761 | A1 | 5/2008 | Rawls-Meehan | |
| 2008/0127418 | A1 | 6/2008 | Rawls-Meehan | |
| 2008/0134431 | A1 | 6/2008 | Piana | |
| 2008/0276373 | A1 | 11/2008 | Clenet | |
| 2008/0295248 | A1 | 12/2008 | Hayes et al. | |

* cited by examiner

MATTRESS RETENTION BRACKET ASSEMBLY AND METHOD

CROSS-REFERENCE TO RELATED APPLICATIONS

This application claims priority to U.S. Provisional Patent Application No. 61/367,643 filed on Jul. 26, 2010, the entire content of which is incorporated herein by reference.

BACKGROUND

A wide variety of mechanisms exist for adjusting the position and shape of supports used for the human body. As used herein, the term "body support" includes without limitation any deformable element or structure adapted to support one or more parts of (or the entire body of) a human in one or more positions. Examples of body supports include but are not limited to mattresses. In those cases where body support adjustment is desired, such adjustment is often performed by changing the shape of a foundation, frame, or other structure underlying the body support (hereinafter referred to simply as a "base"). By way of example only, the base can be an adjustable frame having one or more motors operable to raise and lower one or more areas of the frame, such as areas of the frame corresponding to the head and/or leg portions of the overlying body support. As another example, the adjustable base can also alter one or more angles of the overlying body support with respect to a horizontal plane.

Typically, body supports are supported on adjustable bases by gravity and the weight of one or more users. In some cases, a single fixed bracket is provided at an end of the body support to prevent the body support from sliding off of the adjustable base or otherwise shifting with respect to the base.

In some applications, body supports are resistant to adjustment based upon the material comprising the body support, the construction of the body support, the body support's thickness, and/or other factors. For example, some body supports are resistant to deformation from a generally planar state, and therefore do not readily conform to the shape of the underlying adjustable base in one or more states of the adjustable base. As a result, undesirable spaces can exist between the body support and the adjustable base, and/or one or more ends of the body support can extend past the edges of the adjustable base to an undesirable extent.

By way of example only, and with reference to the prior art body support 10 and body support base illustrated in FIG. 1, the body support 10 is a multi-layered foam mattress having an overall stiffness preventing the body support 10 from conforming to the shape of a foundation 18 and a frame 20 in all positions of the foundation 18 and frame 20—despite the use of a single stationary bracket 28 coupled to the foot end 26 of a foundation 18 of the body support base. The single stationary bracket 28 prevents the body support 10 from sliding off the body support base in one or more positions of the body support base. Nevertheless, an undesirable space (designated by a height "B" in FIG. 1) can exist between the body support 10 and foundation 18 in some positions of the foundation 18 and frame 20, and the head end 22 of the body support 10 can extend significantly beyond the edge of the foundation 18 in some positions of the foundation 18 and frame 20. These issues and other design problems continue to be challenges to the design of comfortable adjustable body supports.

SUMMARY

Some embodiments of the present invention provide an adjustable bracket assembly for the head and/or foot of a body support base, which in some embodiments is itself adjustable. The adjustable bracket assembly can include a bracket that is movable with respect to the body support base to which it is coupled, thereby enabling the bracket's position to change (and in some cases, self-adjust) in response to the relative position of the body support base with respect to the body support. In some embodiments, the bracket is slideable to different positions with respect to the body support base. Also, the bracket assembly can include a spring enabling the position of the bracket to be automatically adjusted (and in some cases, automatically self-adjusted) based upon the relative position of the body support base with respect to the body support, which in some cases can be influenced by the weight of the body support and/or a force exerted by the body support in response to being deformed.

In some embodiments, the bracket assembly includes two compression springs positioned to exert a force against a movable bracket in the direction of length of a mattress. The bracket assembly can be used in conjunction with a fixed bracket coupled to the body support base at another end of the body support, or can be used in conjunction with another adjustable bracket assembly, such as for body supports having spring-loaded or non-spring-loaded brackets located at both the head and foot ends of the body support.

Other aspects of the present invention will become apparent by consideration of the detailed description and accompanying drawings.

DETAILED DESCRIPTION

Before any embodiments of the present invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that phraseology and terminology used herein with reference to order or importance (e.g., "first", "second", and "third") are used herein and in the appended claims for purposes of description, and are not alone intended to indicate or imply relative order or importance unless otherwise specified.

Figure 1:
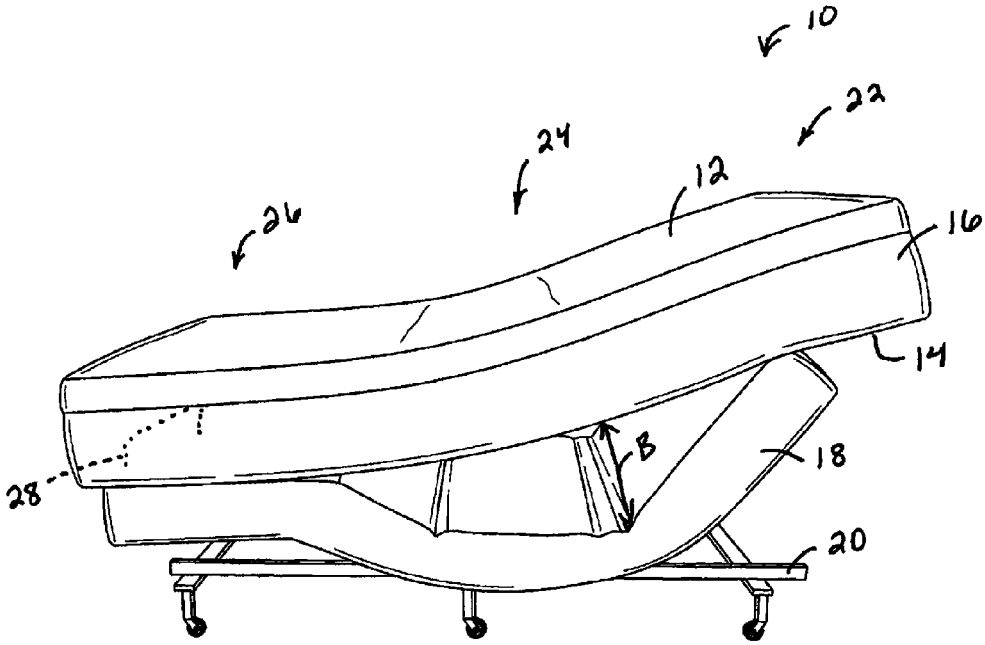
FIG. 1 PRIOR ART
FIG. 1 is a perspective view of a body support and adjustable body support base according to the prior art.
Figure 2:
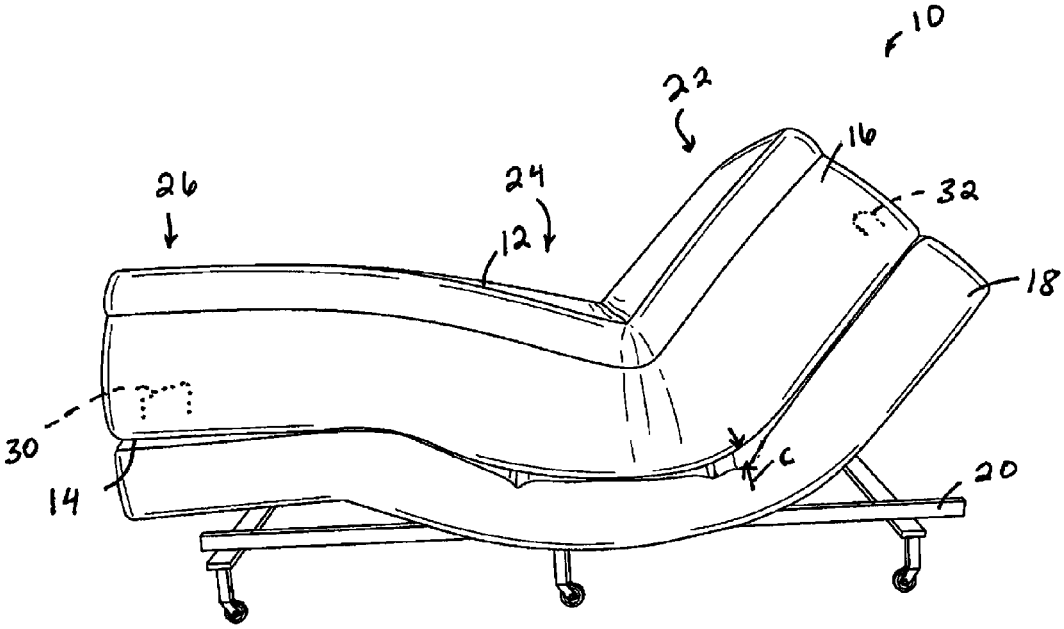
FIG. 2 is a perspective view of a body support and adjustable body support base according to an embodiment of the present invention.
Figure 3:
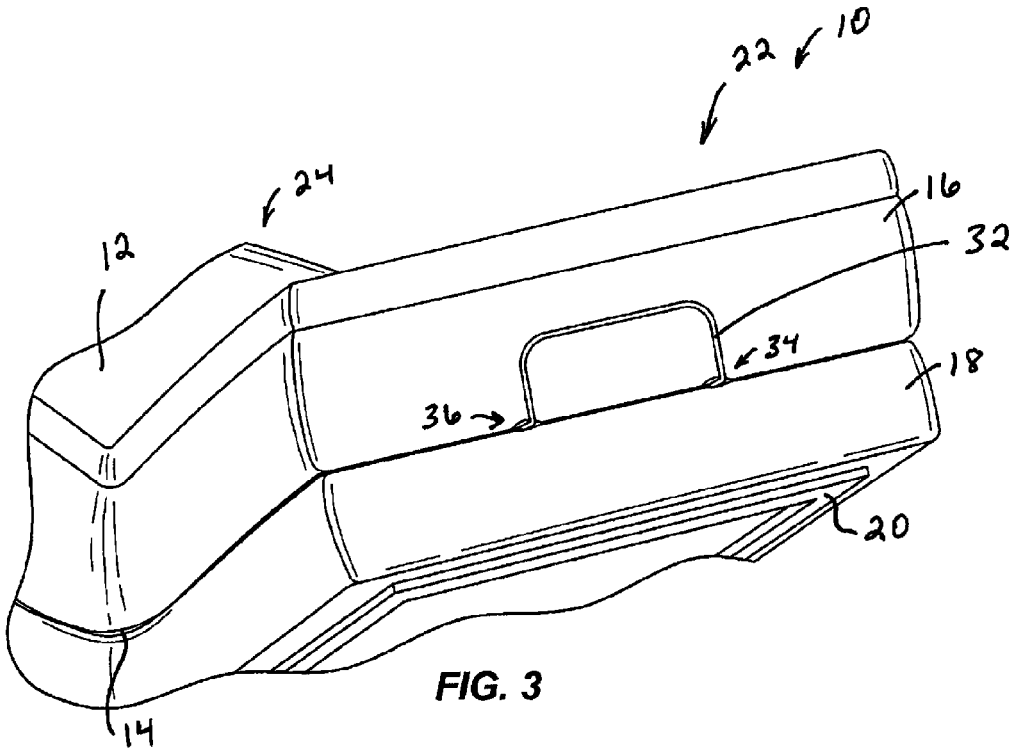
FIG. 3 is a perspective detail view of a first end of the body support and body support base of FIG. 2.
Figure 4:
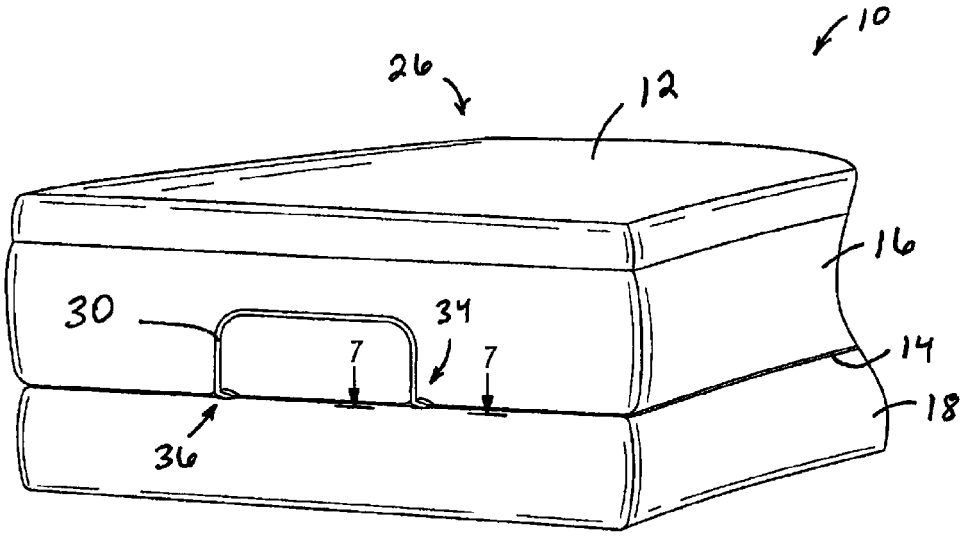
FIG. 4 is a perspective view of a second end of the body support and body support base of FIG. 2.

A body support 10 according to an embodiment of the present invention is illustrated in FIGS. 2-4, and in this embodiment is a mattress by way of example only. The body support 10 includes a top surface 12 dimensioned to support a user and a bottom surface 14 positioned to be proximate a body support base (which in this embodiment includes a foundation 18 and an underlying frame 20). The illustrated frame 20 is adjustable to change the position of the foundation 18, and therefore the body support 10. Although other types of adjustable frames can be used, the illustrated frame is articulated to enable a user to change an angle of inclination of a head end 22 of the frame 20, foundation 18, and body support 10, and to raise and lower the elevation of a leg portion 26 of the frame 20, foundation 18, and body support 10. In some embodiments, a middle portion 24 of the frame 20, foundation 18, and body support 10 move to a lesser extent (or insubstantially) in comparison to the head end 22 and leg portion 26 of the frame 20, foundation 18, and body support 10. It should be noted that the adjustable body support base can be defined by other elements and structure, such as by only a frame 20, by one or more boxes or other enclosures, and the like.

The body support 10 illustrated in FIGS. 1-4 is a mattress 16. However, in other embodiments, the body support 10 can take other forms, such as a mattress topper, overlay, or futon. The body support 10 can include one or more layers of foam, and in some embodiments can also include one or more layers of other material. In some embodiments, the foam layer(s) of the body support 10 include visco-elastic foam.

FIGS. 2-4 illustrate an embodiment of the present invention in which at least one adjustable bracket 30, 32 is coupled to the foundation 18 of the body support base to inhibit substantial sliding of the mattress 16 with respect to the foundation 18 and exerting a non-negligible pressure or force on the body support cushion while also providing a degree of relative movement of the bracket 30, 32 with respect to the foundation 18. This movement can be particularly useful in cases where relative movement between the adjacent ends of the body support 10 and the foundation 18 occurs in adjustment of the foundation 18 to different positions. The adjustable bracket(s) 30, 32 can also encourage the body support 16 to conform to the shape of the foundation 18 and frame 20. With reference to FIG, 2, a much smaller space (indicated by length C in FIG. 2) exists between the mattress 16 and the foundation 1 in the illustrated embodiment. In some embodiments, the length C is less than about 20 cm. In other embodiments, length C has a length of less than about 10 cm. In still other embodiments, length C has a length of less than about 5 cm.

In the illustrated embodiment, a first adjustable bracket 30 is located at the foot end 26 of the foundation 18, and a second adjustable bracket 32 is positioned at the head end 22 of the foundation 18 to resiliently retain the mattress 16 on the foundation 18. In some embodiments, only one of the adjustable brackets 30, 32 is utilized. In such embodiments, one of the adjustable brackets 30, 32 can be replaced by a stationary (i.e., non-adjustable) bracket. The adjustable brackets 30, 32 can be coupled to the foundation 18 to permit the movement of the brackets 30, 32 in a substantially longitudinal direction with respect to the foundation 18 (i.e., in a direction generally extending from the head or leg end 22, 26 of the foundation 18 toward the middle portion 24 of the foundation 18).

In embodiments of the present invention utilizing more than one adjustable bracket 30, 32, the adjustable brackets 30, 32 can be similar in shape and/or size to one another, can be identical, or can be substantially different in shape and/or size to one another. The following description of the adjustable bracket 30 at one end of the illustrated mattress foundation 18 applies equally to the other adjustable bracket 32.

The adjustable bracket 30 illustrated in FIGS. 2 and 4-9 has is generally U-shaped (inverted when installed), with legs coupled to the foundation 18 at respective first and second spaced locations 34, 36. Each leg of the adjustable bracket 30 is attached to the foundation 18 by a respective mount 38. For example, and as shown in FIGS. 5-9, a mount 38 is positioned at each of the first and second locations 34, 36. Although each mount 38 in the illustrated embodiment is substantially identical (with only one of the mounts 38 being described and illustrated herein in detail), it will be appreciated that the mounts 38 can be different to accommodate different bracket shapes and sizes. Also, the illustrated mounts 38 are secured to the foundation 18 of the body support base, the mounts 38 can instead be secured to the mattress 16 and/or to the frame 20.

The mounts 38 are each shaped to permit the bracket 30 to translate with respect thereto, such as by sliding engagement with the mounts 38. With regard to bracket-to-mount sliding engagement by way of example, sliding engagement can be accomplished by using a number of different elements and structures, such as by the bracket 30 slideable within a groove, slot, recess, or other aperture of the mount 38, by the bracket 30 slideable along a tongue, rib, or other protrusion of the mount 38 (in which case the bracket 30 can be provided with a mating groove, slot, recess, or other aperture), by a telescoping relationship between the bracket 30 and the mount 38, and the like. In the illustrated embodiment, for example, each of the illustrated mounts 38 defines a slot 40 that receives the bracket 30. More particularly, the end of the bracket 30 defines a flange 42 slideably received within the slot 40. The flange 42 can take any shape and size suitable for sliding engagement with the bracket 30.

Figure 8:
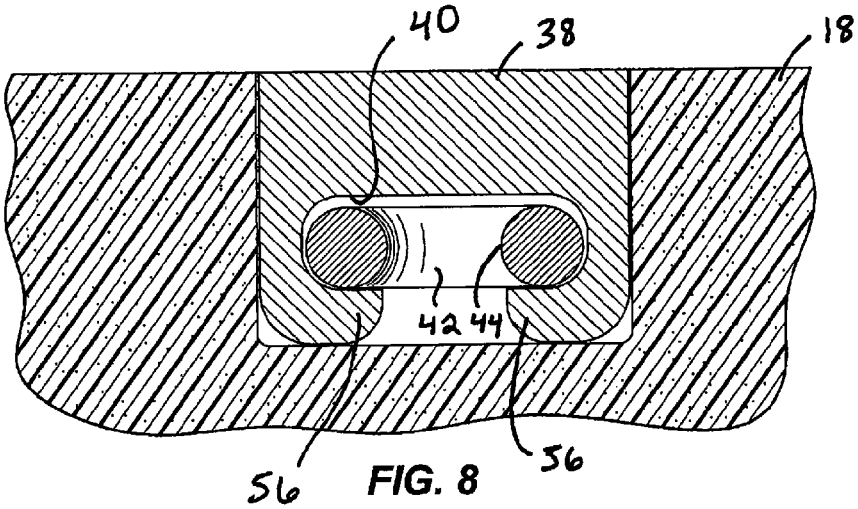
FIG. 8 is a cross-sectional view of a bracket assembly and body support base of FIGS. 2-6, taken along line 8-8 of FIG. 6, and illustrating an alternative mount design.
Figure 9:
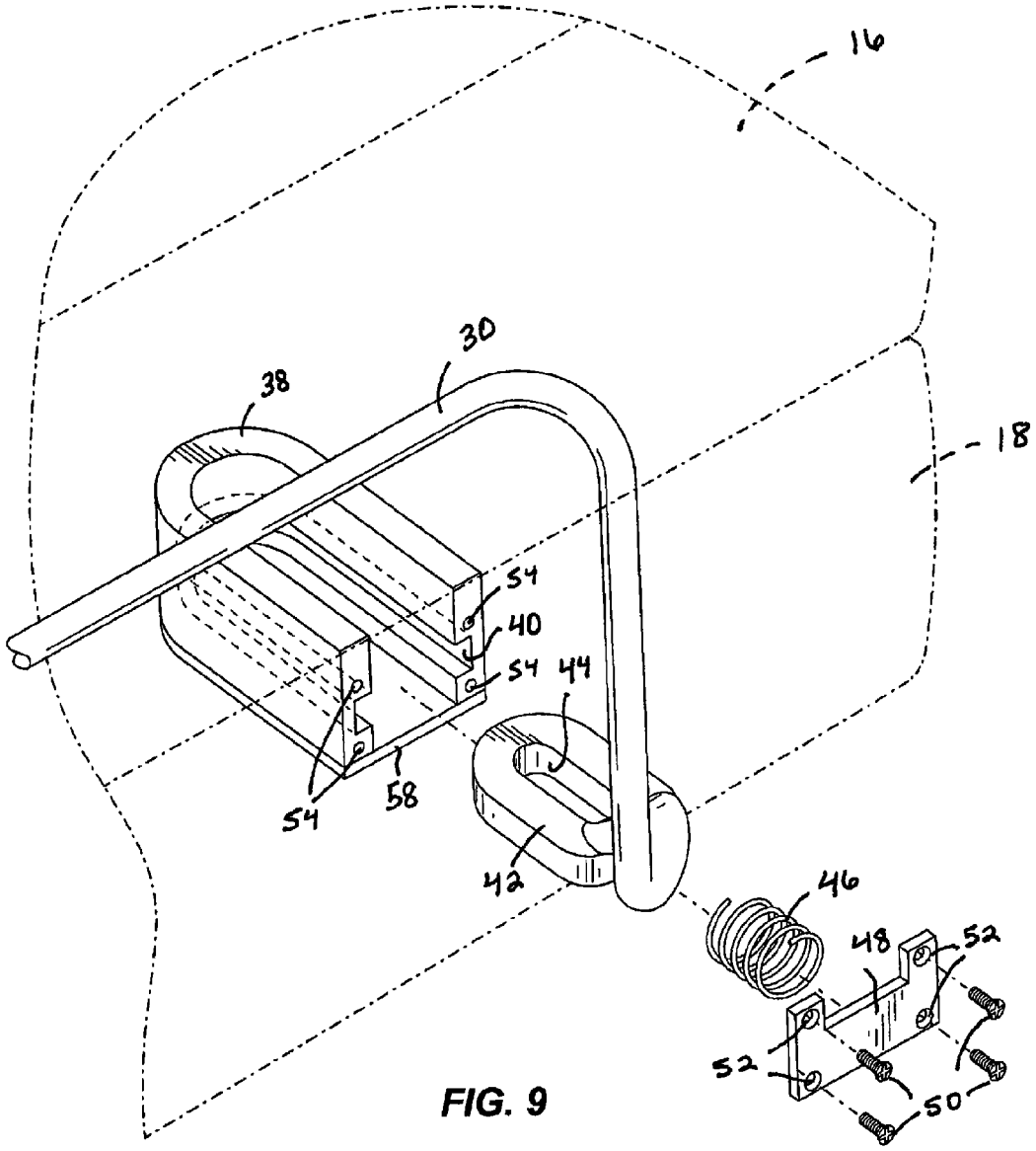
FIG. 9 is an exploded perspective view of a bracket assembly according to an embodiment of the present invention.

The slot 40 in which the bracket 30 is received can be defined in the mount 38 in any desired manner, such as by grooves defined in interior walls of the mount 38. With reference to FIG. 8, the mount 38 in the illustrated embodiment can define lips 56 that extend inward below the flange 42 to retain the flange 42 within the mount 38. In an alternative embodiment, such as illustrated in FIGS. 5 and 9, the mount 38 includes a plate 58 spaced from the mattress 16 to support the mount 38 and retain the flange 42 within the mount 38.

The mount 38 can take any other shape adapted for engagement with the bracket 30, such as a housing, receptacle, flange, rail, track, or other structure dimensioned and shaped to receive or be received within a flange 42 or other mating feature of the bracket 30.

In the illustrated embodiment, the flange 42 defines an elongate aperture 44. However, the flange 42 can have any combination of other configurations, arrangements, shapes and sizes, and in some embodiments can be or at least partially define a housing, receptacle, rail, track, or other structure dimensioned and shaped to receive or be received within a mating component of the mount 38.

Figure 5:
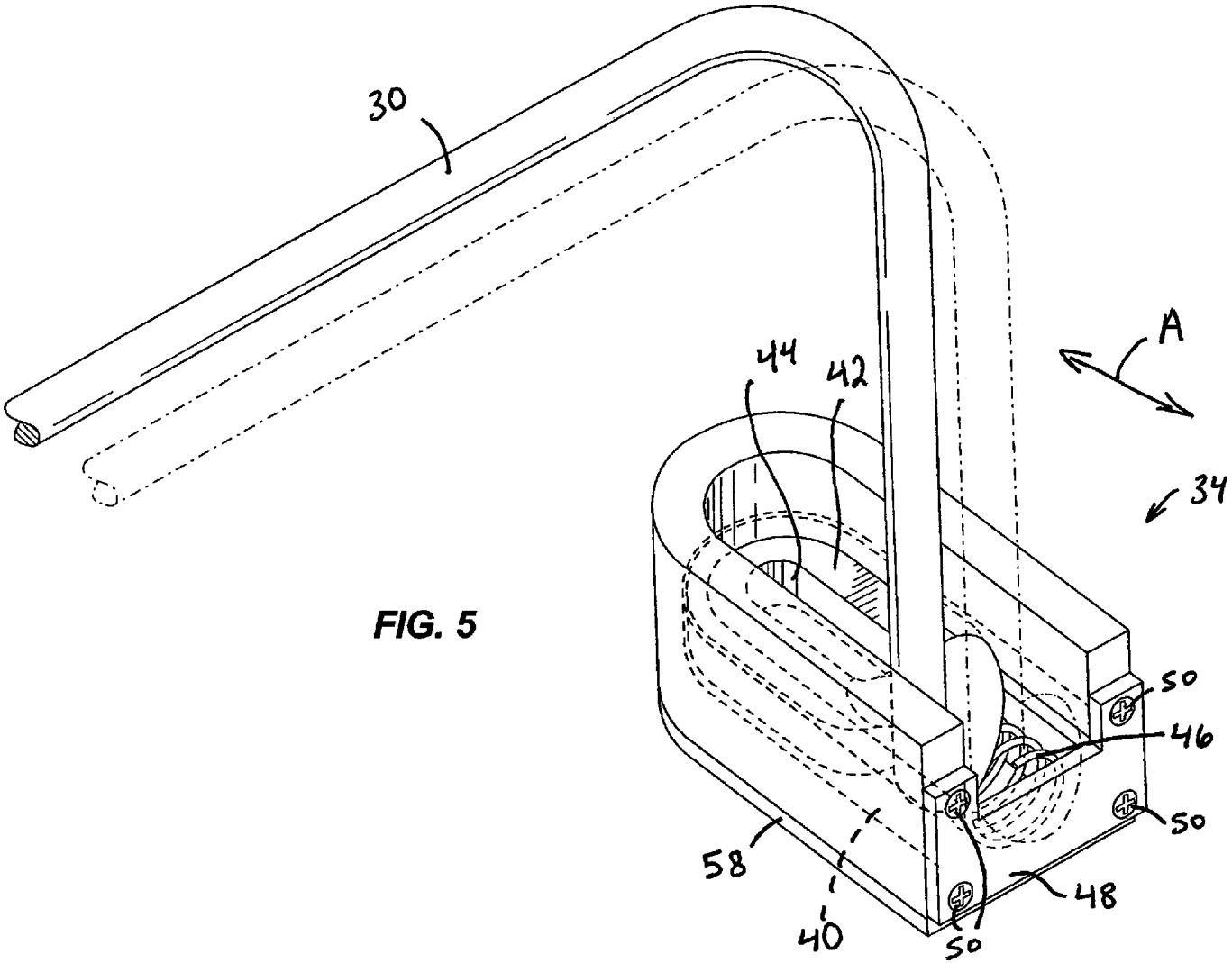
FIG. 5 is a detail view of the bracket assembly of FIG. 4.
Figure 6:
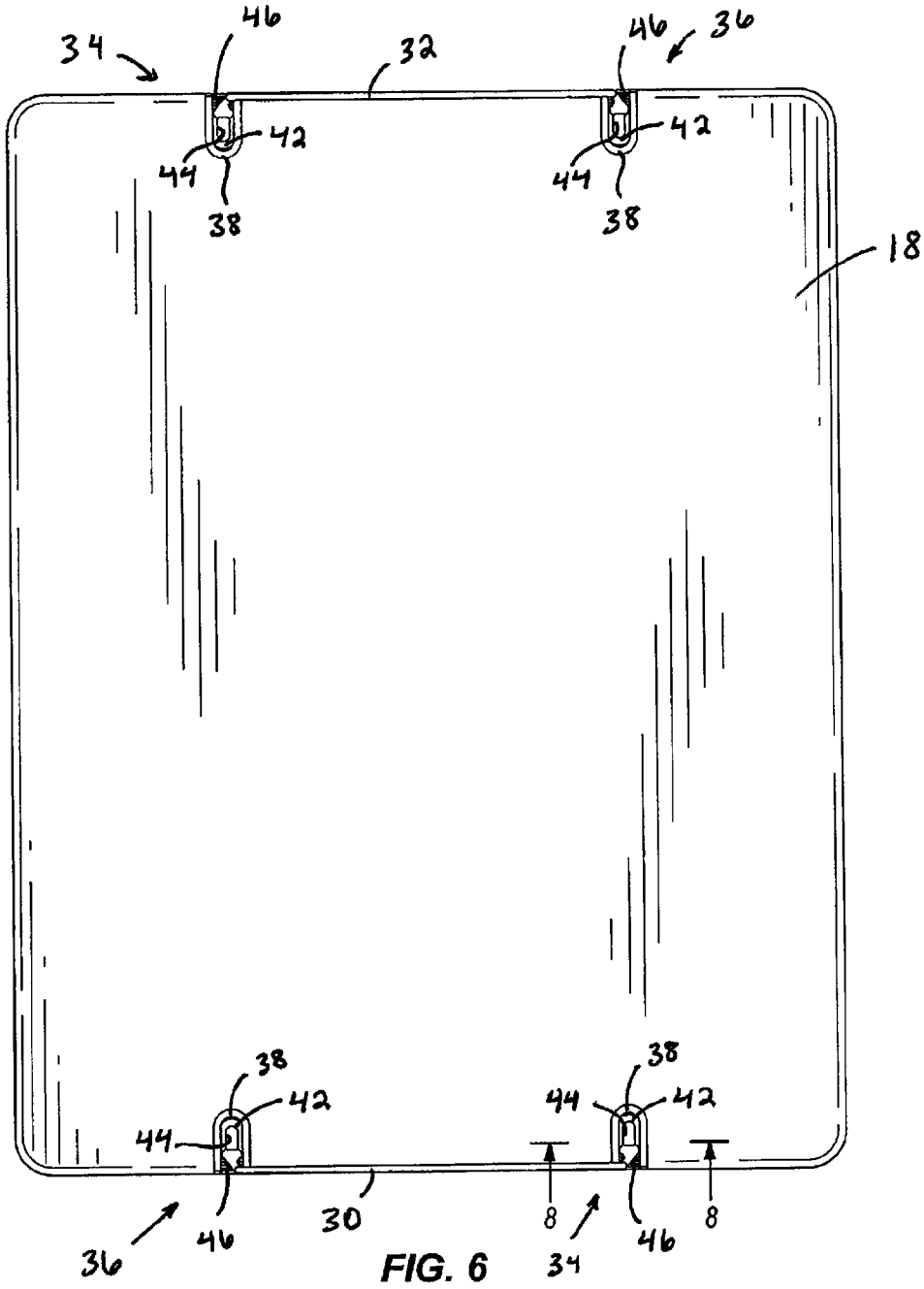
FIG. 6 is a top view of the body support base of FIGS. 2-4.
Figure 7:
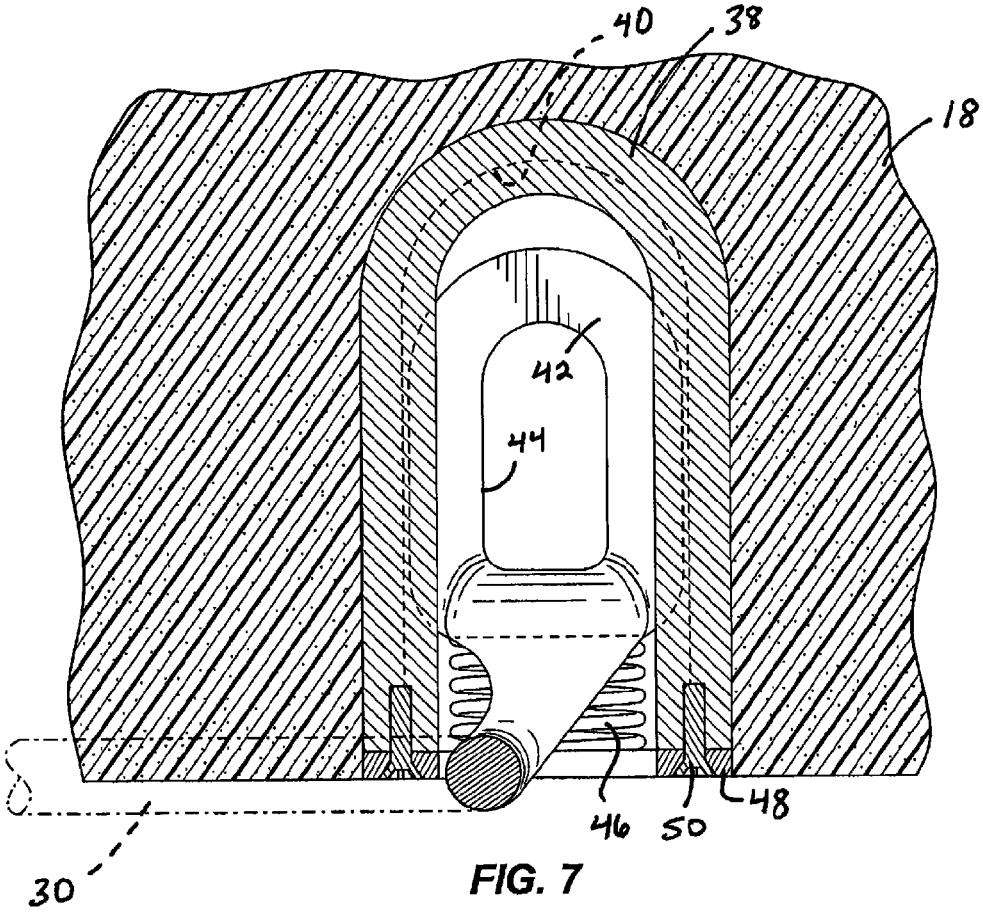
FIG. 7 is a cross-sectional view of a bracket assembly and body support base of FIGS. 2-6, taken along line 7-7 of FIG. 4.

By virtue of the orientation of the bracket 30 with respect to the mounts 38, the bracket 30 is movable to different positions with respect to the foundation 18 (e.g., slideable to different positions along arrow A in FIG. 5, between the position indicted in solid lines and the position indicated in phantom). As described above, some embodiments of the present invention utilize two adjustable brackets 30, 32. In such embodiments, both brackets 30, 32 can be moveable with respect to the foundation 18 in a similar manner.

Some embodiments of the present invention utilize one or more biasing members to urge the bracket 30 in a direction with respect to the foundation 18. For example, and with reference again to FIGS. 5-9, the mount 38 is provided with a coil spring 46 positioned to urge the bracket 30 in a direction toward the middle portion 24 of the foundation 18. The coil spring 46 can be positioned at least partially within the mount 38 for this purpose, or in some embodiments can be in other positions suitable for exerting a biasing force against the bracket 30. In the illustrated embodiment, the coil spring 46 biases the flange 42 of the bracket 30 (and therefore, the bracket 30), although other portions of the bracket 30 can be biased in alternate embodiments.

By providing a biasing force upon the bracket 30 as discussed above, the coil spring 46 urges the bracket 30 against a mattress 16 on top of foundation 18. While coil springs 46 can be used to perform this function, it will be appreciated that in other embodiments, the biasing member can instead be or include a leaf spring, an extension spring, a torsion spring, a compressible or elastomeric band or other component, a hydraulic or pneumatic spring (with compressible fluid therein), or any other suitable biasing member. Alternatively, the biasing member can be omitted in other embodiments.

In some embodiments, one or more elements of the mount 38 are used to retain the bracket 30 in engagement with the mount 38. In the illustrated embodiment, a stop member, such as a plate 48, can be coupled to retain at least one of the spring and the bracket 30 (e.g., the flange 42 of the bracket 30) at least partially within the mount 38. The plate 48 can be coupled to the mount 38 in any suitable manner, such as with fasteners 50 received within apertures 52 in the plate 48 and corresponding apertures 54 within the mount 38. Although the illustrated fasteners 50 are screws, any other type of suitable fasteners (such as nails, bolts, rivets, clamps, clips, inter-engaging elements, welds, and the like) can be used as desired. In some embodiments, the mount 38 and plate 48 are constructed as a single, unitary element, in which case fasteners 50 may not be necessary.

Although the invention has been described in detail with reference to certain preferred embodiments, variations and modifications exist within the scope and spirit of one or more independent aspects of the present invention. For example, although the present invention has been described in connection with body supports 10 for adjustable body support bases (e.g., with adjustable mattress frames), it will be appreciated that one or more adjustable body support bracket assemblies according to various embodiments of the present invention can be utilized in applications where no body support base adjustability exists. In such cases, the ability of the bracket assembly or assemblies to be easily positioned with respect to a body support 10 (and in some cases, automatically positioned with one or more springs as described above) can provide significant advantages to a user.

What is claimed is:

1. A body support assembly comprising:

a body support including a head portion, a middle portion, and a foot portion;

a foundation underlying and supporting the body support proximate an edge of the body support at one of the head and foot portions;

a bracket coupled to the foundation and slideable between first and second positions when the bracket is engaged with the edge of the body support, the bracket having an inboard side substantially facing the body support and an outboard side opposite the inboard side; and a spring on the outboard side of the bracket and positioned to bias the bracket toward the body support while permitting movement of the body support past an edge of the foundation in at least one position of the bracket.

2. The body support of claim 1, wherein the spring is coupled to the bracket.

3. The body support of claim 1, wherein the bracket is a first bracket, the body support further comprising a second bracket coupled to the foundation and slideable between third and fourth positions when the second bracket is engaged with another edge of the body support.

4. The body support of claim 3, further comprising a spring coupled to the second bracket to bias the second bracket toward the body support.

5. The body support of claim 3, wherein the first and second brackets are coupled to opposite ends of the foundation.

6. The body support of claim 1, wherein the frame is an adjustable frame including at least one moving portion positioned to support one of the head portion and the foot portion of the body support.

7. The body support of claim 1, wherein the bracket is secured to the foundation by a mount on the foundation.

8. The body support of claim 1, further comprising a frame underlying and supporting the foundation.

9. The body support of claim 8, wherein the frame is adjustable to raise and lower at least one of the head portion and foot portion of the body support.

10. A method of supporting a body support on a foundation, the method comprising:

positioning a body support on a foundation;

limiting movement of the body support with respect to the foundation with a bracket extending to a location at an end of the body support;

biasing the bracket toward the body support with a spring, wherein the bracket is located between the body support and the spring;

translating the bracket with respect to the foundation in response to fore and aft translation of the foundation, and permitting movement of the body support past an edge of the foundation by translating the bracket.

11. The method of claim 10, further comprising biasing the bracket against the body support to resiliently retain the body support on the foundation.

12. The method of claim 10, further comprising further limiting movement of the body support with respect to the foundation with a second bracket extending to another location at an opposite end of the body support.

13. The method of claim 12, further comprising biasing the second bracket against the body support to resiliently retain the body support on the foundation.

14. The method of claim 10, wherein translating the bracket comprises sliding the bracket with respect to a mount coupled to the foundation.

15. The method of claim 10, further comprising supporting the foundation and body support upon a frame.

16. The method of claim 15, further comprising supporting the foundation and body support upon a frame; and adjusting the frame by moving a first portion of the frame with respect to a second portion of the frame.

17. The method of claim 16, further comprising resisting movement of the body support with the bracket in at least one position of the frame.

18. The method of claim 10, further comprising pressing the body support toward the foundation by exerting pressure of the bracket against the body support.

19. The method of claim 10, further comprising moving the bracket toward and away from an edge of the foundation.

20. The method of claim 19, wherein moving the bracket comprises sliding a portion of the bracket with respect to a mount coupled to the foundation.

* * * * *